US007690536B2

(12) United States Patent
Briozzo Fernandez

(10) Patent No.: US 7,690,536 B2
(45) Date of Patent: Apr. 6, 2010

(54) FOAM DISPENSER

(75) Inventor: Diego Sebastian Briozzo Fernandez, Buenos Aires (AR)

(73) Assignee: The Sun Products Corporation, Wilton, CT (US)

( * ) Notice: Subject to any disclaimer, the term of this patent is extended or adjusted under 35 U.S.C. 154(b) by 514 days.

(21) Appl. No.: 10/543,472

(22) PCT Filed: Jan. 19, 2004

(86) PCT No.: PCT/EP2004/000406

§ 371 (c)(1),
(2), (4) Date: Jul. 28, 2005

(87) PCT Pub. No.: WO2004/067188

PCT Pub. Date: Aug. 12, 2004

(65) Prior Publication Data

US 2006/0138171 A1 Jun. 29, 2006

(30) Foreign Application Priority Data

Jan. 30, 2003 (EP) ..... 03250593

(51) Int. Cl.
*B65D 83/00* (2006.01)

(52) U.S. Cl. ..... 222/211; 222/190; 222/209; 239/342; 239/343

(58) Field of Classification Search ..... 222/211, 222/189.1, 190, 321.4, 376, 402.19, 464.1–464.2, 222/209; 239/333, 342–343, 370
See application file for complete search history.

(56) References Cited

U.S. PATENT DOCUMENTS 402,921 A * 5/1889 Gordon ..... 239/339

(Continued)

FOREIGN PATENT DOCUMENTS

DE 1 081 613 5/1960

(Continued)

OTHER PUBLICATIONS

Office Action mailed Jan. 28, 2008, in U.S. Appl. No. 10/543,474, Fernandez, filed Dec. 12, 2005.

(Continued)

*Primary Examiner*—Kevin P Shaver
*Assistant Examiner*—Andrew P Bainbridge
(74) *Attorney, Agent, or Firm*—Sterne, Kessler, Goldstein & Fox P.L.L.C.

(57) ABSTRACT

A dispenser (1) for dispensing a mixture of two or more fluids, e.g. liquid (9) and gas (4) (e.g. air) as a foam and/or mist, the dispenser comprising a flexible container (6) for a liquid including a conduit (8) having first and second end portions (11,12) the first end portion (11) terminating in an opening in the container (6) through which the mixture is expelled from the container (6) and the second open end portion (12) being close to the base of said container, wherein the conduit (8) includes a third open end portion (13) which is located close to the top (16) of the container and laterally inclined or opposed to the second open end portion (12) and the dispenser further being provided with one or more three-dimensional turbulence elements (26) mounted in the flow path of the liquid before it leaves the dispensing opening.

25 Claims, 2 Drawing Sheets

U.S. PATENT DOCUMENTS

| | | | | | |
|---|---|---|---|---|---|
| 2,315,263 | A | * | 3/1943 | Lindsay | 169/72 |
| 2,358,329 | A | | 9/1944 | Houghton | |
| 2,642,313 | A | * | 6/1953 | Montenier | 239/434 |
| 2,706,582 | A | * | 4/1955 | Flamm | 222/207 |
| 2,770,399 | A | * | 11/1956 | Gross | 222/211 |
| 2,981,444 | A | | 4/1961 | Root | |
| 3,234,880 | A | * | 2/1966 | Hampton | 417/90 |
| 3,260,421 | A | * | 7/1966 | Rabussier | 222/402.18 |
| 3,346,146 | A | * | 10/1967 | Thompson | 222/190 |
| 3,471,064 | A | * | 10/1969 | Micallef | 222/211 |
| 3,506,162 | A | * | 4/1970 | Schwartzman | 222/207 |
| 4,019,661 | A | * | 4/1977 | Szabo | 222/376 |
| 4,020,979 | A | | 5/1977 | Shay et al. | |
| 4,091,966 | A | | 5/1978 | Laauwe | |
| 4,147,306 | A | * | 4/1979 | Bennett | 239/327 |
| 4,414,168 | A | * | 11/1983 | Hankin | 264/49 |
| 4,615,467 | A | * | 10/1986 | Grogan et al. | 222/190 |
| 4,730,751 | A | * | 3/1988 | Mackles et al. | 222/211 |
| 5,014,881 | A | * | 5/1991 | Andris | 222/207 |
| 5,169,034 | A | * | 12/1992 | Kozam | 222/211 |
| 5,219,102 | A | * | 6/1993 | Wright | 222/190 |
| 5,271,530 | A | * | 12/1993 | Uehira et al. | 222/190 |
| 5,289,952 | A | * | 3/1994 | Gueret | 222/190 |
| 5,310,093 | A | * | 5/1994 | Bennett | 222/190 |
| 5,341,968 | A | * | 8/1994 | Vandoninck | 222/396 |
| 5,443,569 | A | * | 8/1995 | Uehira et al. | 222/190 |
| 5,624,060 | A | * | 4/1997 | Ellion et al. | 222/376 |
| 5,875,933 | A | * | 3/1999 | Ellion et al. | 222/189.1 |
| 5,897,032 | A | * | 4/1999 | Ellion et al. | 222/189.1 |
| 5,979,712 | A | * | 11/1999 | Montaner et al. | 222/321.4 |
| 6,053,364 | A | * | 4/2000 | van der Heijden | 222/145.6 |
| 6,293,441 | B1 | * | 9/2001 | Tasaki et al. | 222/376 |
| 6,394,315 | B1 | * | 5/2002 | Banks | 222/190 |
| 6,505,986 | B1 | * | 1/2003 | Oder | 401/183 |
| 6,860,404 | B2 | * | 3/2005 | Duqueroie | 222/1 |
| 6,945,473 | B2 | * | 9/2005 | Garcia et al. | 239/327 |
| 2002/0113090 | A1 | | 8/2002 | Gross et al. | |
| 2002/0179735 | A1 | * | 12/2002 | Santagiuliana | 239/327 |
| 2003/0075554 | A1 | | 4/2003 | Duqueroie | |
| 2003/0155375 | A1 | * | 8/2003 | da Silva | 222/211 |
| 2006/0213931 | A1 | | 9/2006 | Fernandez | |
| 2007/0119875 | A1 | * | 5/2007 | Ehret et al. | 222/386.5 |

FOREIGN PATENT DOCUMENTS

| | | | | |
|---|---|---|---|---|
| DE | 100 64 630 | | | 12/2000 |
| DE | 10064630 | A1 | * | 6/2002 |
| EP | 1 279 607 | | | 1/2003 |
| JP | 56150452 | | | 11/1981 |
| JP | 56150452 | A | * | 11/1981 |
| JP | 10081895 | | | 3/1998 |
| JP | 10081895 | A | * | 3/1998 |
| WO | WO 8909095 | A1 | * | 10/1989 |
| WO | WO 9110601 | A1 | * | 7/1991 |
| WO | WO 03/043743 | A1 | | 5/2003 |

OTHER PUBLICATIONS

Office Action mailed Jul. 9, 2008, in U.S. Appl. No. 10/543,474, Fernandez, filed Dec. 12, 2005.

* cited by examiner

FOAM DISPENSER

BACKGROUND OF THE INVENTION

1. Field of the Invention

The present invention concerns dispensers which dispense a mixture of fluids, particularly but not exclusively portable dispensers which dispense, under pressure, foam from a mixture of fluids e.g. gas and liquid.

2. The Related Art

The term "portable" as used herein is intended to mean handheld dispensers, preferentially dispensers that can be held with only one hand, such as commercially available dispensers for deodorants, shaving-foam, or liquid cleaning compositions. The invention is also suitable for large portable dispensers, that cannot be held with only one hand.

Foam dispensers to dispense a mixture of liquid and gas as a foam are known. As a common characteristic, they comprise a container and a dispensing cap, said cap comprising a dispensing opening which, at least during dispensing, is in open connection with the upper end of a flow pipe (known as dip tube), of which the opposite end is located near the bottom of the container. Liquid and gas are pushed out of the dispensing opening together due to the pressure difference between the inside and outside of the container. Conveniently the pressurised gas in the containers is air but it may be another suitable gas. The increased or 'positive' (relative to external pressure) internal pressure is permanent in pressurised containers. For non-pressurised containers the internal pressure can be decrease/increased manually and temporarily with a pump system to draw air into container and then expel this. Some pump systems raise the internal pressure sufficient to provide for a multitude of dispensing operations. Other pump systems e.g. those forming part of various pump dispensing heads or caps increase internal pressure as part of the dispensing operation. Examples of such dispensing systems are trigger spray heads. Dispensers of this and similar kind are disclosed in U.S. Pat. Nos. 6,053,364, 5,271,530, 5,443,569, etc. One problem with such trigger spray head dispensers is that they are expensive and are not economic in use of plastic resource.

Mist dispensing systems which operate by manual squeezing of a liquid filled flexible-walled container or 'squeeze bottle' are also known. Such containers are used for dispensing a mist or spray. Manual compression of the container increases the internal pressure in the head space above the liquid, compelling the liquid to rise upward through the dip tube and be ejected from the container.

Due to the configuration of the cap dispensing orifice and/or the use of two-dimensional structures the liquid can be expelled as a spray.

An exemplary embodiment of such dispenser is shown in U.S. Pat. No. 2,642,313, published in 1953.

Known foam or mist dispensers are sold with a solution inside the container and a flat mesh or net in the flow path of the liquid to form the mist. However, such foam forming elements can be expensive to manufacture and are often not very efficient for creating a desired thick foam.

The present invention seeks to solve or at least reduce the above mentioned problems by the provision of a simple, cost effective foam dispenser which does not require complicated foaming elements in the flow path of the liquid i.e. somewhere in the dip tube that conveys the liquid from the bottom of a container towards the container cap or above the dip tube in the container cap.

SUMMARY OF THE INVENTION

Therefore the invention provides a dispenser for dispensing a mixture of two or more fluids, e.g. liquid and gas (e.g. air) as a foam and/or mist, the dispenser comprising a flexible container for a liquid including a conduit having first and second end portions, the first end portion terminating in a dispensing opening in the container through which the mixture is expelled from the container and the second open end portion being close to the base of said container, wherein the conduit includes a third open end portion which is located close to the top of the container and laterally inclined or opposed to the second open end portion and the dispenser further being provided with one or more three-dimensional turbulence elements mounted in the flow path of the liquid before it leaves the dispensing opening.

With this arrangement an effective foam dispenser is provided whereby a mixture of fluids e.g liquid and air can be ejected from the container simply by squeezing the container. The provision of openings at the top and bottom of the container allow the device to function whether it is orientated upright (top above base) or inverted. Further, as the second and third conduit openings are mutually laterally inclined or opposed the device also operate when it is tilted sideways.

Other additional turbulence elements may be mounted in other parts of liquid flow path.

Turbulence elements of the present invention may mounted movably in the liquid flow path and may act in a bifunctional way as a turbulence generator as well as a valve.

Where (as is described in more detail hereinbelow) the conduit/dip tube is provided with one or more upper ends and/or one or more lower ends, meaning that said pipe can be branched or split thus providing additional ends, these one or more ends may be provided with at least one turbulence element.

In order to provide for enough gas inside the container to obtain a satisfactory foam, the liquid preferably occupies less than 95% of the total volume inside the container of the dispenser, more preferably less than 90%.

In some embodiments of the invention the dispenser comprises a mixing chamber in the liquid flow path, preferably close to the dispensing opening in the cap and down-stream from the opening connecting the liquid flow path to the headspace in the container. Alternatively that opening may be in the mixing chamber such that gas (air) and liquid meet in the mixing chamber. In more preferred examples of these embodiments the turbulence element may be mounted in the mixing chamber or be part of the mixing chamber.

As used here, a three-dimensional turbulence element is any and all three-dimensional structure capable of provoking turbulence of the liquid while flowing to the dispensing opening of the dispenser. As examples of such structures, without the exclusion of any other, 3-D turbulence elements can be sets of lashes or bristles inside the dip tube or mixing chamber, or next to the ends thereof, as well as parallel or random sets of fins, parallel or randomly arranged apertured or non-apertured flat disks of same or different diameters, a distribution of filaments either loose or as a woven or nonwoven web or plug, shaped particles like spheres, cylinders, other mixed and irregular shapes, porous elements such as pumice stone or natural or artificial polymeric foam, etc.

Combinations of two or more turbulence elements are also suitable.

The presence of a turbulence element at the liquid output end is particularly suitable to the formation of foam, which can be turned into mist depending on the geometry of the output orifice and the pressure used, as is known by those skilled in the art.

The cap of the dispenser of the invention can be of any shape, aimed at the function of closing the container after it has been filled with the liquid and allowing same to be dispensed. When the container used is flexible, a cap having an orifice and a coupling for the upper end of the dip tube are particularly suitable. When the container used is rigid, the cap can house a pumping device to be actuated by the user's fingers, for instance also comprising a coupling for the upper end of the conduit and/or a mixing chamber.

The conduit may be branched, curved or kinked or a combination thereof to effect the relative orientation of the second and third conduit end portions.

The conduit may be curved or kinked in a section e.g. mid or upper section, so as to incline the second open end portion between 10-60 degrees to the longitudinal axis of the container, preferably 15-45 degrees, more preferably 15-30 degrees, even more preferably 20 degrees.

The third open end portion may extend from an upper section (ie. Toward the top of the container when it is orientated upright) of the conduit, e.g at right angles.

The conduit may have tee (T-shaped) configuration at the top, wherein the third open end portion branches off orthogonally from a main section of the conduit, preferably generally longitudinally aligned.

The top of the conduit may be offset from the central longitudinal axis.

The conduit may be in the form of or include a dip tube which may co-operate with a container closure or cap also provided.

The container may be flexible by means of one or more flexible portions, and the invention is not restricted to an entirely flexible container. Rigid sections eg. Base, corners etc may be included e.g. for increasing strength.

A dispenser of this invention can have any shape suitable to portability and handling, without excluding any shape.

The cap of the dispenser of the invention can be of any shape, aimed at the function of closing the container after it has been filled with the liquid and allowing same to be dispensed.

The dispenser parts may be made of any material suitable for the purpose. A majority, if not all, of the parts are suitably made from polymeric material.

The dispensers according to the invention may be used for any liquid intended to be dispensed as a foam or mist. Examples are: edible liquids such as cream or milk, paint or cleaning liquids. They are particularly suitable for dispensing cleaning liquids as a foam. Such cleaning liquids generally contain a foaming surfactant, preferably in completely dissolved form. They may also contain other components known in the art as components of cleaning liquids. They may even contain solid particulate matter provided it is in stable suspension in the liquid. Preferred, however, are cleaning liquids that do not contain any undissolved solid matter.

Non-limiting embodiments of the invention are outlined below with reference to the drawings attached hereto.

BRIEF DESCRIPTION OF THE DRAWING

Non-limiting embodiments of the invention are outlined below with reference to the drawings attached hereto.

DETAILED DESCRIPTION OF THE INVENTION

Figure 1:
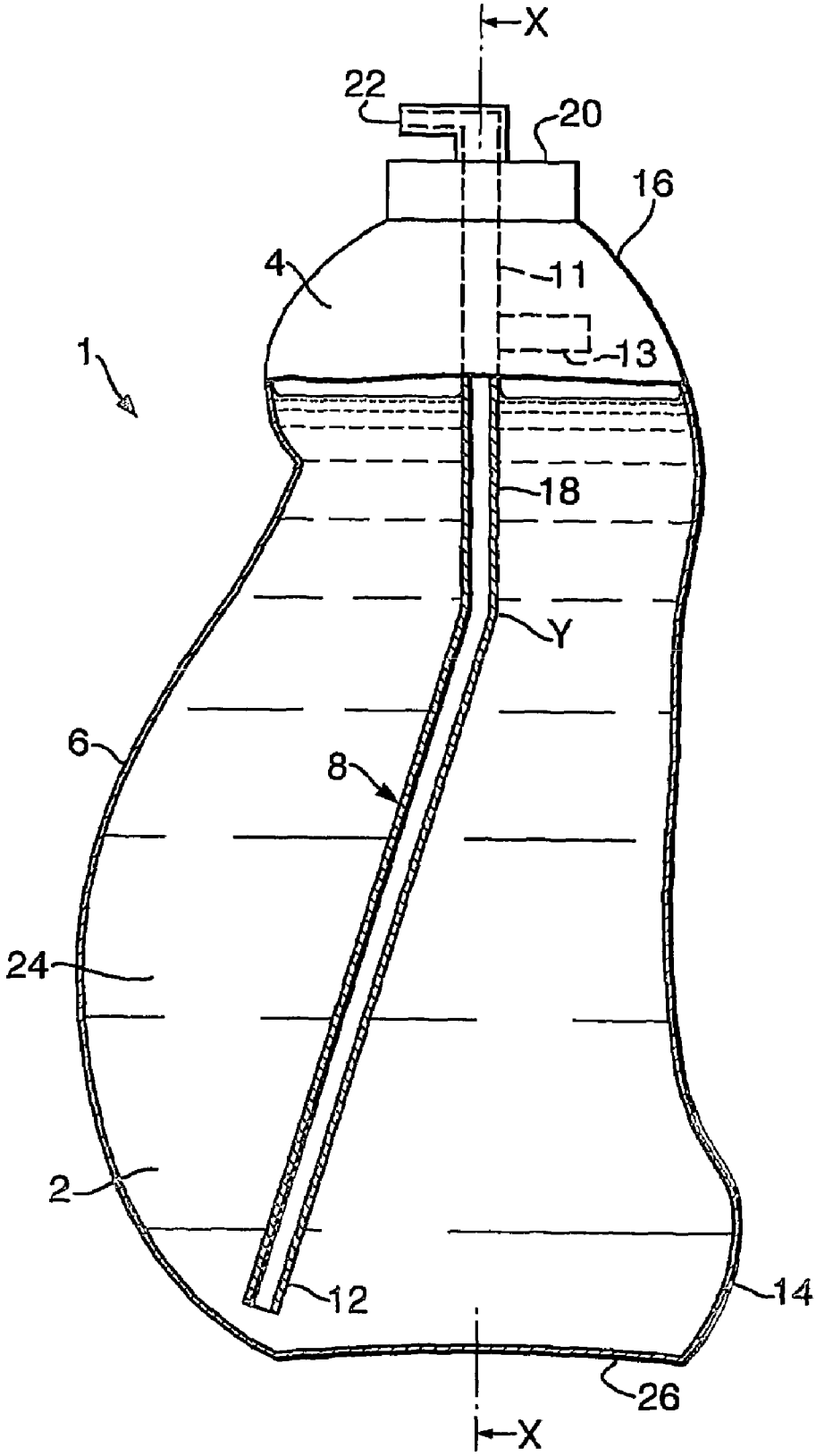
FIG. 1 shows a schematic diagram of one embodiment of the invention (turbulence element not shown).

Referring to FIG. 1, there is shown a dispenser 1 for dispensing a mixture of two or more fluids 2, 4, e.g. liquid 3 and gas i.e. air 4 as a foam and/or mist. The dispenser 1 comprises a flexible container 6 for containing the liquid and includes a conduit 8 comprising a dip tube 8*a* having first and second end portions 11, 12 the first end portion 11 terminating in an opening in the container 6 through which the mixture 2,4 is expelled from the container and the second open end portion 12 being close to the base 14 of said container 6, wherein the conduit 8 includes a third open end portion 13 which is located close to the top 16 of the container 6 and laterally inclined or opposed to the second open end portion 12.

With this arrangement a cost effective foam dispenser is provided which does not require complicated foaming elements in the flow path of the liquid. A mixture of fluids e.g liquid and air can be ejected from the container simply by squeezing the container. The provision of openings at the top and bottom of the container allow the device to function whether it is orientated upright (with central longitudinal axis upright, and top above base) or inverted (base above top).

Further, as the second and third conduit openings 12,13 are laterally opposed the dispenser 1 also operates when it is tilted sideways.

The conduit is kinked or bent (at Y) generally in its upper section 18, so as to incline the second open end portion 12 approximately 20 degrees to the longitudinal axis of the container 6.

The third open end portion 13 extend from an upper section 18 (ie. Toward the top of the container when it orientated upright) of the conduit 8, e.g at right angles. The conduit may have tee (T-shaped) configuration at the top, wherein the third open end portion branches off orthogonally from a main section of the conduit, preferably generally longitudinally aligned.

The conduit comprises a dip tube in co-operation with the container closure 20 having dispensing opening 22.

The container is flexible by means of a generally flexible body portion 24. However certain sections eg the base 26 and optionally corner portions may have increased rigidity e.g. for increasing strength.

The dispenser parts may be made of any material suitable for the purpose. A majority, if not all, of the parts are suitably made from polymeric material.

Figure 2:
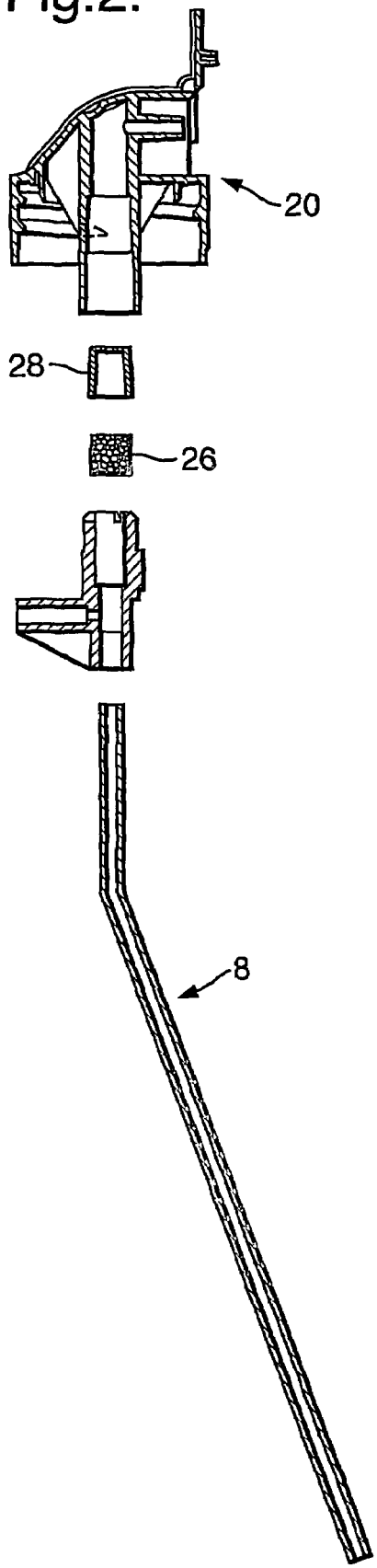
FIG. 2 shows an exploded view of the diptube and container cap of FIG. 1, but also showing the turbulence element.

Referring now to FIG. 2 which shows the turbulence element, cap 20 and the dip tube 8 (in exploded view) are shown.

The turbulence element comprises a die cut polyurethane sponge 26 inserted into a conical injected cylinder 28 made of polypropylene. Relative dimensions of the sponge 26 and cylinder 28 are calibrated to assure optimum valve performance.

In use, the dispenser 1 is filled with liquid 2 to leave a head space of air 4.

The container is then simply compressed by squeezing the body portion 24 to expel liquid and air via the sponge 26, where they mix to form foam, from the container.

It will be clear one skilled in the art, with the aid of the text and the figures presented herein, that there are many possible alternative embodiments permitted by this invention without departing from the scope of protection provided by the following claims.

The invention claimed is:

1. A dispenser for dispensing a liquid and gas mixture as a foam or mist, the dispenser comprising a flexible container for a liquid and a gas including a conduit having first and second end portions separated by a main tubular section, the first end portion terminating in a dispensing opening in the container through which the mixture is expelled from the container and the second end portion being close to a base of said container, wherein the conduit includes a third end portion having an open mouth defined by a plane oriented parallel to and distant from the main tubular section, the third end portion being located close to a top of the container and laterally but non-circumferentially branching off from the main section, the dispenser further being provided with a polyurethane sponge as a three-dimensional turbulence elements element mounted in a flow path of the mixture before the mixture leaves the dispensing opening, the dispenser not having any mesh or net in a flow path of the liquid nor having a pump dispensing head.

2. Dispenser according to claim 1 wherein the gas and the liquid flowing to the dispensing opening meet just before or while the gas and liquid pass through the turbulence element.

3. Dispenser according to claim 1 further comprising a mixing chamber in the flow path close to the dispensing opening in a cap and down-stream from, or comprising, the dispensing opening connecting the flow path to a head space in the container.

4. Dispenser according to claim 3 wherein the turbulence element is mounted in, or is part of, the mixing chamber.

5. Dispenser according to claim 1 wherein the conduit has a configuration selected from the group consisting of branched, curved, kinked or a combination geometry thereof, to effect relative orientation of the second and third end portions.

6. Dispenser according to claim 1 wherein the conduit is curved or kinked to incline the second open end portion between 10-60 degrees to a longitudinal axis of the container.

7. Dispenser according to claim 1 wherein the third end portion extends from the main tubular section of the conduit at right angles.

8. Dispenser according to claim 1 wherein a top of the conduit is offset from a central longitudinal axis of the container.

9. Dispenser according to claim 1 wherein the liquid is a cleaning liquid comprising a foaming surfactant.

10. Dispenser according to claim 1 wherein the liquid is a cleaning liquid that does not contain undissolved solids.

11. Dispenser according to claim 1 wherein the container is filled with the liquid to less than 95% of an internal volume of the container.

12. A method of dispensing a foam or mist using a dispenser according to claim 1, the dispenser containing a liquid and the method comprising squeezing the dispenser to expel the liquid as a foam or mist.

13. A method of treating or cleaning a surface comprising applying a foam or mist to the surface using a dispenser according to claim 1, the dispenser containing a surface treatment or cleaning composition.

14. A dispenser for dispensing a liquid and gas mixture, the dispenser comprising a flexible container for a liquid and a gas including a conduit having first and second end portions separated by a main tubular section, the first end portion terminating in a dispensing opening in the container through which the mixture is expelled from the container and the second end portion being close to a base of said container, the conduit including a third end portion having an open mouth defined by a plane parallel to and distant from the main tubular section, the third end portion being located close to a top of the container and extending from an upper section of the conduit, wherein the third end portion laterally but non-circumferentially branches off from the main tubular section, the dispenser not having any mesh or net in a flow path of the liquid nor having a pump dispensing head.

15. Dispenser according to claim 14 wherein the conduit has a form selected from the group consisting of branched, curved, kinked or a combination geometry thereof to effect a relative orientation of the second and third end portions.

16. Dispenser according to claim 14 wherein the conduit is curved or kinked to incline the second end portion between 10-60 degrees to a longitudinal axis of the container.

17. Dispenser according to claim 16 wherein the conduit is kinked in the upper section by 20 degrees.

18. Dispenser according to claim 14 wherein a top of the conduit is aligned with a central longitudinal axis of the container.

19. Dispenser according to claim 14 wherein a top of the conduit is offset from a central longitudinal axis of the container.

20. Dispenser according to claim 14 wherein the conduit is a dip tube which co-operates with a container closure or cap.

21. Dispenser according to claim 14 wherein the liquid is selected from the group consisting of cream, milk, or a cleaning liquid.

22. Dispenser according to claim 21 wherein the cleaning liquid does not contain undissolved solids.

23. Dispenser according to of claim 14 wherein the container is filled with the liquid to less than 95% of an internal volume of the container.

24. A method of dispensing a foam or mist using a dispenser according to claim 14, the dispenser containing a liquid and the method comprising squeezing the dispenser to expel the liquid as a foam or mist.

25. A method of treating or cleaning a surface comprising applying a foam or mist to the surface using a dispenser according to claim 14, the dispenser containing a surface treatment or cleaning composition.

* * * * *